US006270378B1

(12) United States Patent
Lee

(10) Patent No.: US 6,270,378 B1
(45) Date of Patent: Aug. 7, 2001

(54) BATTERY TERMINAL WIRING DEVICE

(75) Inventor: Gue-Dong Lee, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/472,590

(22) Filed: Dec. 27, 1999

(30) Foreign Application Priority Data

Jun. 23, 1999 (KR) ..... 99-23643

(51) Int. Cl.[7] ..... H01R 19/00

(52) U.S. Cl. ..... 439/627; 320/107

(58) Field of Search ..... 439/627, 510; 320/107, 110

(56) References Cited

U.S. PATENT DOCUMENTS 1,460,604 * 8/1923 Potter ..... 439/627
5,821,732 * 10/1998 Chen ..... 320/110
6,097,173 * 8/2000 Bryant, Jr. ..... 320/107

* cited by examiner

*Primary Examiner*—Gary F. Paumen
*Assistant Examiner*—Alexander Gilman
(74) *Attorney, Agent, or Firm*—Christie, Parker & Hale, LLP

(57) ABSTRACT

A battery terminal wiring device for an electric vehicle includes a slide conductor having a longitudinal slot, a connecting node for electrically connecting the slide conductor to a motor, and a plurality of terminal caps interposed between the slide conductor and terminals of batteries so as to make electric connections therebetween.

4 Claims, 3 Drawing Sheets

BATTERY TERMINAL WIRING DEVICE

BACKGROUND OF THE INVENTION (a) Field of the Invention

The present invention relates to battery terminal wiring, and in particular, to an improved battery terminal wiring device capable of simplifying serial connection of several battery terminals as well as the connection of sensing wires to each terminal, in an electric vehicle application.

(b) Description of the Related Art

FIG. 4 shows a battery set 4 which is comprised of a plurality of batteries 2 that are serially connected to each other with wires 16, and two end terminals of the serial connection are connected to an inverter 6 such that a DC current is supplied to a motor 8. A sensing wire 12 is connected to a terminal of each battery 2 such that a condition of each is monitored by a battery control unit 14 that is connected to the other end of the sensing wire.

However, in the above battery set 4, the terminals 10 of the batteries 2 are connected with wires by means of soldering such that many hours of work are required for wiring, and when cells are exchanged the possibility exists that the batteries may short circuit.

SUMMARY OF THE INVENTION

The present invention has been made in an effort to solve the above problems of the prior art.

It is an object of the present invention to provide a battery terminal wiring device which will simplify both the serial wire connections between batteries and the parallel connections of the sensing wires to the battery terminals.

To achieve the above object, a battery terminal wiring device for an electric vehicle according to the present invention comprises a slide conductor having a longitudinal slot therein, a connecting node for electrically connecting the slide conductor to a motor, and a plurality of terminal caps interposed between the slide conductor and the terminals of the batteries so as to make electrical connections therebetween.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
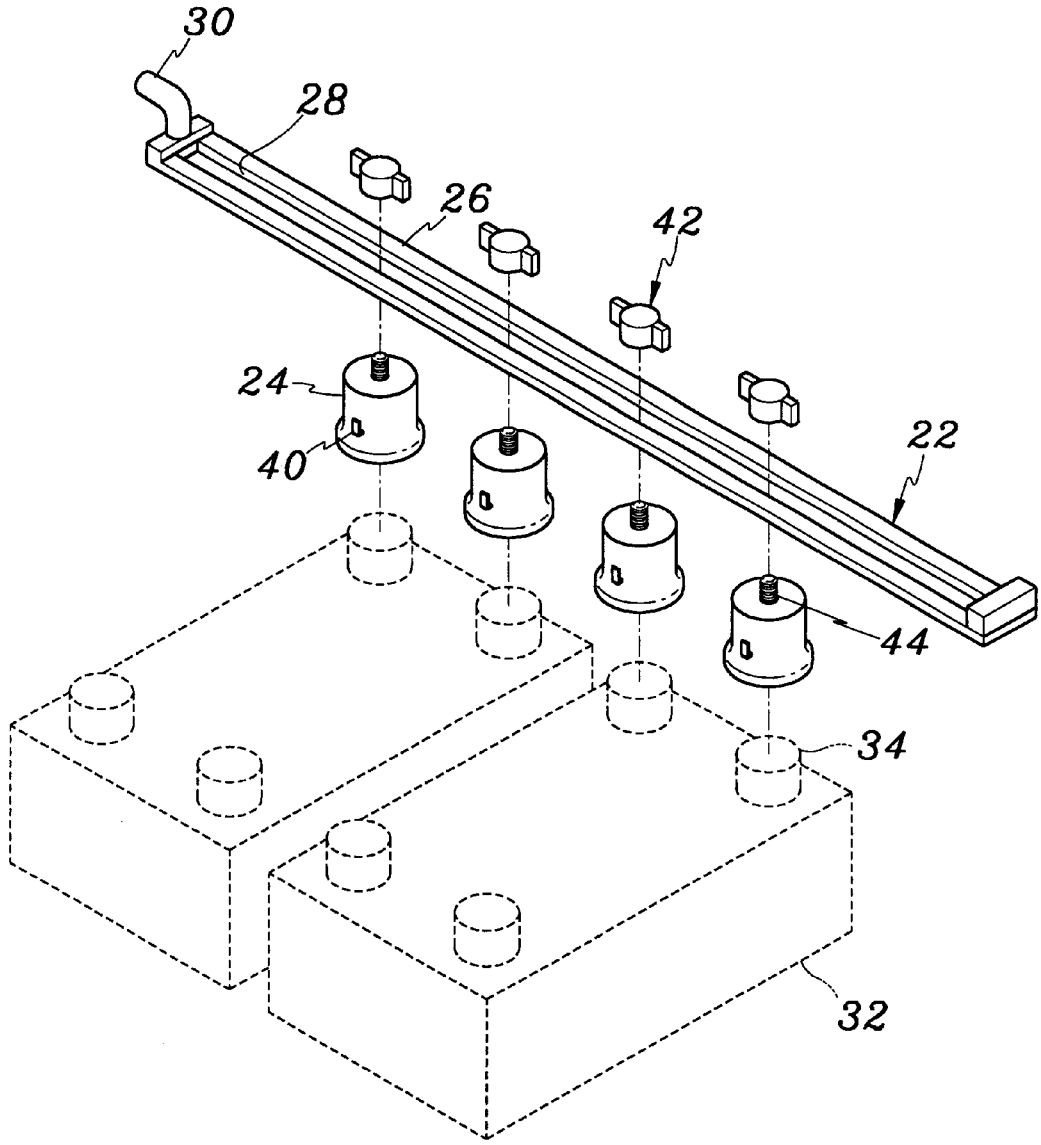
FIG. 1 is a perspective view showing a disassembled battery terminal wiring device according to a preferred embodiment of the present invention.
Figure 2:
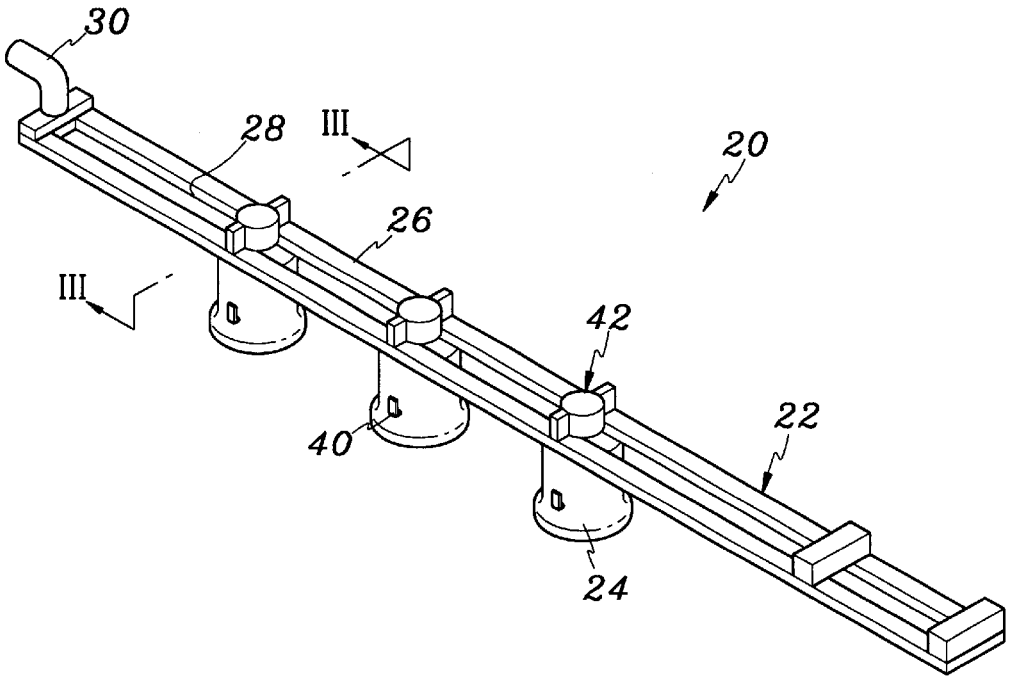
FIG. 2 is a perspective view showing an assembled battery terminal wiring device of FIG. 1.
Figure 3:
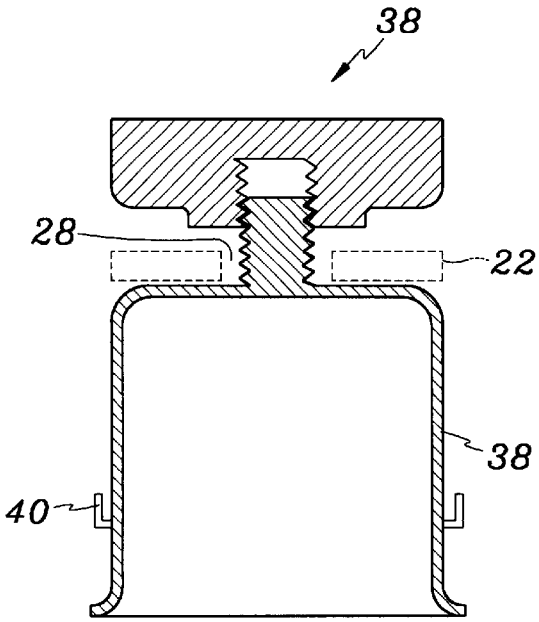
FIG. 3 is a cross sectional view of a cut along line III—III in FIG. 2.
Figure 4:
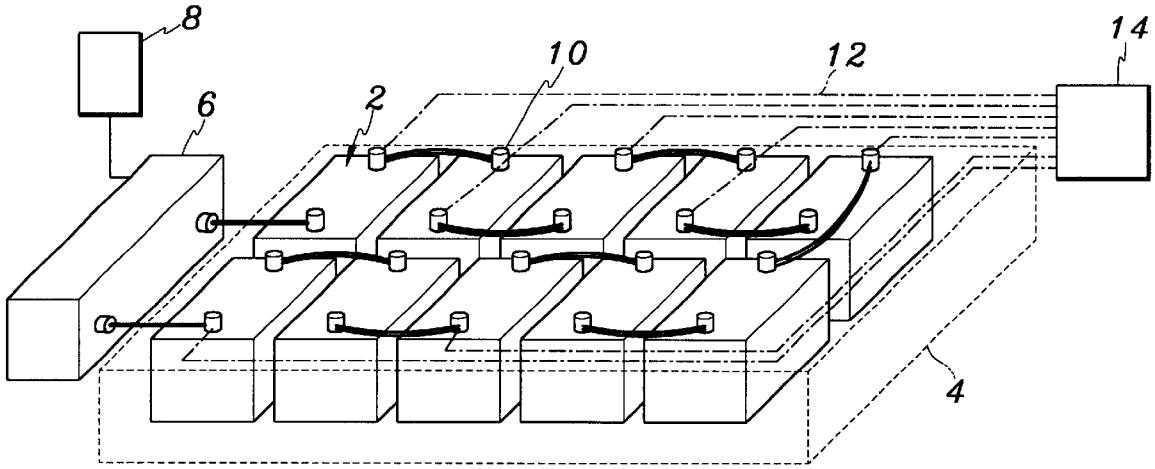
FIG. 4 is a perspective view showing a prior art battery of an electric vehicle.

FIG. 1 and FIG. 2 are respectively a perspective view showing a disassembled and an assembled battery terminal wiring device, and FIG. 3 is a cross sectional view of a cut along line A—A in FIG. 2.

As shown in FIG. 1 and FIG. 2, the battery terminal wiring device 20 according to a preferred embodiment of the present invention comprises a slide conductor 22 and a plurality of terminal caps 24.

The slide conductor 22 has a slot 28 in a longitudinal direction thereof and a connecting node 30 at one of its ends such that the connecting node is electrically connected to a motor by means of a wire.

Each terminal cap 24 has a cap body 38 for covering a terminal 34 of a battery cell 32, a bolt member 44 formed on an upper portion of the cap body 38, a wing nut 42 for fixing the terminal cap 24 to the slide conductor 22 by screwing it onto the bolt member 44, and a sensing wire receiver 40 for receiving a sensing wire thereon.

As shown in FIG. 3, each battery terminal 34 is electrically connected to the slide conductor 22 in such a way that when the terminal cap 24 is placed over the battery terminal 34, the bolt member 44 protrudes through the longitudinal slot formed in the slide conductor 22, and the wing nut 42 is screwed onto the bolt member 44 so as to fit the slide conductor 22 therebetween.

The slide conductor 22 is electrically connected to the motor by a wire from its connecting node 30 such that a DC current can be supplied to the motor.

The sensing wire receiver 40 formed on a side wall of the terminal cap 24 receives a sensing wire such that a condition of each battery is monitored by a battery control unit.

As described above, serially wiring batteries using the battery terminal wiring device of the present invention can simplify both terminal wiring and battery exchange, and labor time is saved because there is no need to solder.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A battery terminal wiring device for an electric vehicle comprising:

a slide conductor having a longitudinal slot, wherein the longitudinal slot allows the conductor to be adapted to connect batteries of varying sizes;

a connecting node attached to the slide conductor for electrically connecting the slide conductor to a motor; and a plurality of terminal caps interposed between the slide conductor and the battery terminals for making electrical connections, the terminal caps each including a cap body for covering a battery terminal and a bolt member formed on an upper portion of the cap body, wherein the bolt member of each cap body passes through the longitudinal slot in the slide conductor and is attached to the slide conductor by means of a wing nut.

2. The battery terminal wiring device of claim 1, wherein each cap body has a sensing wire receiver for receiving a sensor wire.

3. The battery terminal wiring device of claim 1, wherein each cap body is adapted for use with automotive battery terminals.

4. A battery terminal wiring device for an electric vehicle having an electric motor comprising:

a slide conductor having a longitudinal slot, wherein the longitudinal slot allows the conductor to be adapted to connect batteries having terminals of varying sizes;

a connecting node attached to the slide conductor for electrically connecting the slide conductor to the motor via a wire; and a plurality of terminal caps, wherein each cap is interposed between the slide conductor and one battery terminal for making an electrical connection between the conductor and the terminal;

the terminal caps each including a cap body for mechanically attaching to a battery terminal and a bolt member formed on an upper portion of the cap body, wherein the bolt member of each cap body passes through the longitudinal slot in the slide conductor and is attached to the slide conductor by means of an electrically conductive wing nut.

* * * * *